United States Patent [19]

Fuller

[11] Patent Number: 4,861,102

[45] Date of Patent: Aug. 29, 1989

[54] TRAY ASSEMBLY FOR ATTACHMENT TO FOLDING CHAIRS AND OTHER SUPPORTING STRUCTURES

[76] Inventor: Jerald W. Fuller, 2000 Skyline Blvd., Reno, Nev. 89509

[21] Appl. No.: 317,136

[22] Filed: Mar. 1, 1989

Related U.S. Application Data

[63] Continuation of Ser. No. 169,749, Mar. 18, 1988; abandoned.

[51] Int. Cl.[4] ..... A47B 83/02; A47C 7/62

[52] U.S. Cl. ..... 297/162; 297/194; 108/49

[58] Field of Search ..... 297/162, 194; 108/152, 108/134, 49; 248/231.8, 316.7

[56] References Cited

U.S. PATENT DOCUMENTS

| | | | |
|---|---|---|---|
| 1,862,237 | 6/1932 | Pepler | 108/49 |
| 2,533,893 | 12/1950 | Nussbaum | 108/49 X |
| 2,703,265 | 3/1955 | Wolfe | 108/49 X |
| 2,925,123 | 2/1960 | Morgan | 297/162 |
| 2,994,366 | 8/1961 | Hoch | 297/162 |
| 3,166,354 | 1/1965 | Sorensen | 297/194 |
| 3,194,526 | 7/1965 | Lemmond | 248/231.8 |
| 3,265,436 | 8/1966 | LaBombard et al. | 292/162 |
| 3,367,714 | 2/1968 | Stone | 297/194 |
| 3,494,661 | 2/1970 | Leyburn | 297/188 |
| 3,586,367 | 6/1971 | Cincotta | 297/162 |
| 4,213,649 | 7/1988 | Sell | 297/189 |
| 4,266,825 | 5/1981 | LeDonne | 297/194 |
| 4,300,798 | 11/1981 | Musgrove et al. | 297/162 |

FOREIGN PATENT DOCUMENTS

| | | | |
|---|---|---|---|
| 852697 | 10/1960 | United Kingdom | 297/162 |

*Primary Examiner*—Francis K. Zugel

*Attorney, Agent, or Firm*—Flehr, Hohbach, Test, Albritton & Herbert

[57] ABSTRACT

Tray assembly for attachment to folding chairs and other supporting structures. The tray assembly includes a base adapted to be mounted on a supporting structure, a support arm which is mounted on the base, and a tray which is mounted on the support arm. The support arm has first and second cylindrical mounting pins which are received in tight frictional engagement in semi-cylindrical mounting ferrules on the base and the tray. The pins can be rotated within the ferrules to move the support arm and table to different angular positions relative to the base and the support arm, with the support arm and the table being held securely in the different positions by the frictional engagement between the pins and the ferrules.

18 Claims, 4 Drawing Sheets

FIG_7
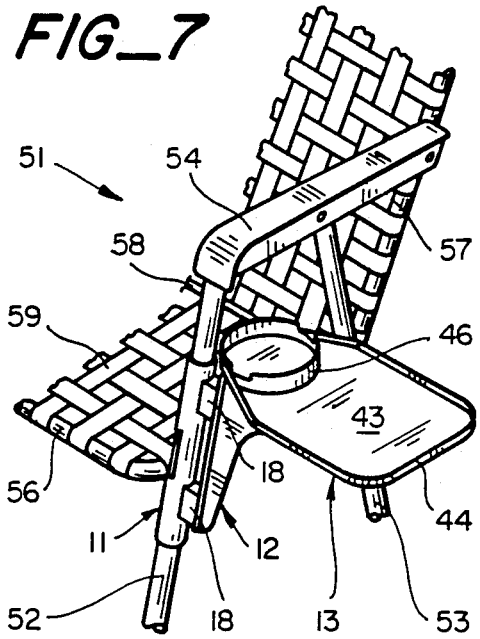
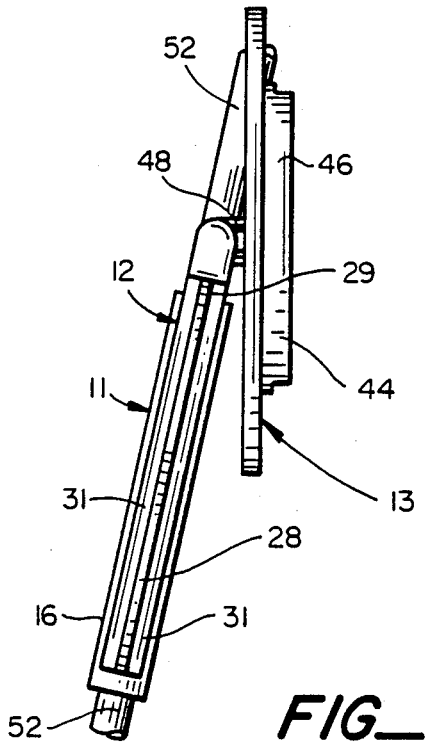
FIG_8

TRAY ASSEMBLY FOR ATTACHMENT TO FOLDING CHAIRS AND OTHER SUPPORTING STRUCTURES

This is a continuation of application Ser. No. 169,749, filed Mar. 18, 1988.

This invention pertains generally to tables and trays for holding drinks and other items, and more particularly to a tray assembly for attachment to folding chairs and other supporting structures.

U.S. Pat. No. 4,213,649 describes a drink holding tray having a pair of rotatively mounted spring clips for attachment to the diverging legs of a folding lawn chair. To avoid interference with the folding of the chair, the spring clips must grip the legs loosely enough to permit the clips to slid along the legs as the chair is folded, and this relatively loose fit may cause the tray to sag under the weight of a drink.

U.S. Pat. No. 3,265,436 discloses a tray having a support rod which is clamped in an upright position to a leg of a chair and a tray which is supported by the upright rod and by a bracket attached to the arm on the other side of the chair.

Additional examples of tables or trays for attachment to folding chairs and lounges are found in U.S. Pat. Nos. 2,925,125, 3,166,354, 3,367,714 and 3,494,661.

It is in general an object of the invention to provide a new and improved tray assembly for attachment to folding chairs and other supporting structures.

Another object of the invention is to provide a tray assembly of the above character which overcomes limitations and disadvantages of attachable trays and tables heretofore provided.

Another object of the invention is to provide a tray assembly of the above character which is economical to manufacture and easy to use.

These and other objects are achieved in accordance with the invention by providing a tray assembly comprising a base adapted to be mounted on a supporting structure, a support arm which is mounted on the base, and a tray which is mounted on the support arm. The support arm has first and second cylindrical mounting pins which are received in tight frictional engagement in semi-cylindrical mounting ferrules on the base and the tray. The pins can be rotated within the ferrules to move the support arm and table to different angular positions relative to the base and the support arm, with the support arm and the table being held securely in the different positions by the frictional engagement between the pins and the ferrules.

FIG. 7 is an isometric view of the tray assembly of FIG. 1 mounted on a folding chair.

FIGS. 8 and 9 are elevational views showing the tray assembly in different positions as the chair on which it is mounted is folded.

Figures 1, 2:
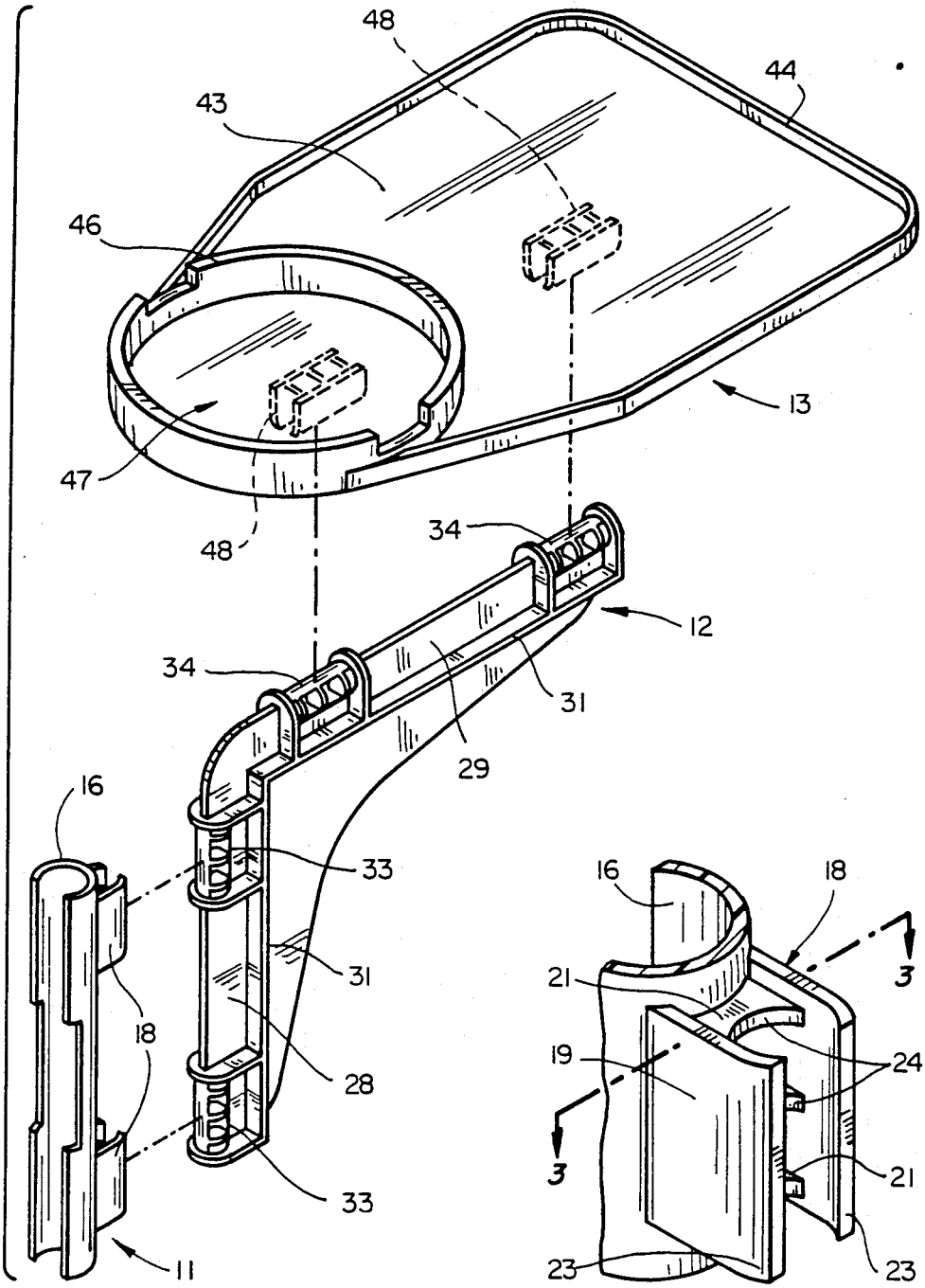
FIG. 1 is an exploded isometric view of one embodiment of a tray assembly according to the invention.
FIG. 2 is a fragmentary isometric view of a portion of the base in the embodiment of FIG. 1, illustrating one of the mounting ferrules.

As illustrated in FIG. 1, the tray assembly comprises a base 11 which is adapted to be mounted on a supporting structure such as the leg of a folding chair, a support arm 12 which is mounted on the base, and a tray 13 which is mounted on the support arm. As discussed more fully hereinafter, the support arm and the table are mounted in such manner that they can be rotated about generally vertical and horizontal axes to position the tray in a stable, level position.

The body of base 11 is an elongated semi-cylindrical ferrule 16 which is adapted to snap onto a cylindrical element such as the tubular leg of a folding lawn chair. The inner diameter of the ferrule is made somewhat less than the outer diameter of the supporting element so that the ferrule will grip the supporting element tightly and hold the tray assembly in a stable position on the element. For mounting on a leg having an outer diameter of 1 inch, for example, ferrule 16 would have an inner diameter on the order of 0.096 inch.

Base 11 has a pair of semi-cylindrical ferrules 18 which receive cylindrical mounting pins on support arm 12 in tight frictional engagement. The ferrules are aligned axially of each other, and they permit the support arm to be rotated to different angular positions relative to the base. At the same time, however, the ferrules grip the pins tightly enough to hold the support arm securely in the different positions so that the arm remains in that position until it is moved again.

Figure 3:
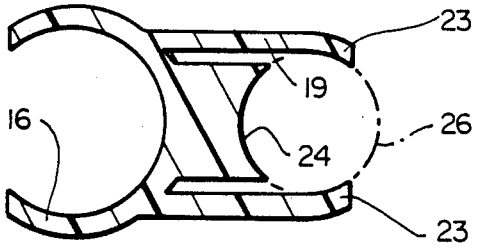
FIG. 3 is a cross-sectional view taken in the plane of line 3—3 in FIG. 2.

As best seen in FIGS. 2 and 3, each of the ferrules 18 has a pair of side flanges 19 and a plurality of journal blocks 21 which are spaced axially apart between the side flanges. The outer portions 23 of the side flanges and the outer surfaces 24 of the journal blocks are each formed with an arcuate curvature and positioned such that the arcs lie on the surface of a cylinder 26 of slightly lesses diameter than the mounting pins which are received in the ferrules. The opening between the outer portions of the flanges has an arc length on the order of 110°, and the ferrules are thus adapted for snapping engagement with the mounting pins.

Support arm 12 is an L-shaped bracket having a vertically extending section 28 and a horizontally extending section 29. The bracket is a generally planar structure, with a laterally projecting rib 31 extending lengthwise of the two sections and giving the structure lateral rigidity.

Mounting pins 33, 34 are positioned along the outer edges of the two sections of the support arm for engagement with the mounting ferrules on base 11 and tray 13. Two such pins are provided on each section of the arm, with the two pins on each section being aligned axially of each other and the two aces intersecting at a right angle near the outer corner of the L-shaped bracket.

Figure 4:
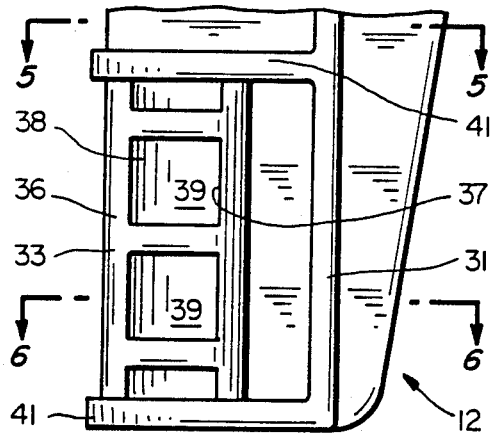
FIG. 4 is a fragmentary side elevational view of a portion of the support arm in the embodiment of FIG. 1, illustrating one of the mounting pins.
Figure 5:
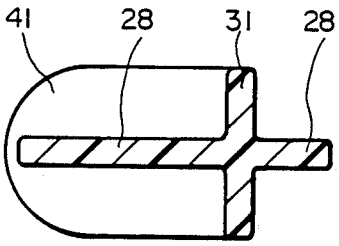
FIG. 5 is a cross-sectional view taken along line 5—5 in FIG. 4.
Figure 6:
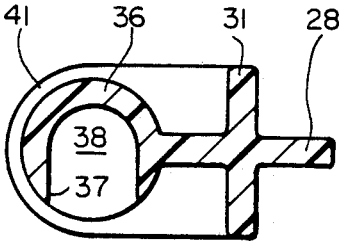
FIG. 6 is a cross-sectional view taken along line 6—6 in FIG. 4.

The four mounting pins on the support arm are of similar construction, and the pin toward the lower end of vertical section 28 is illustrated in detail in FIGS. 4–6. This pin has a semi-cylindrical side wall 36 with an opening 37 on one side thereof and a plurality of axially spaced radial blocks 38 which extend through the opening in the side wall. The outer ends 39 of the blocks have the same curvature as the outer surface of the side wall, and together they give the pin a smooth circular peripheral contour for engagement with the inner surfaces of flanges 19 and the outer surfaces of journal blocks 24 of a mounting ferrule. End flanges 41 retain the mounting ferrule axially in position on the mounting pin, with journal blocks 24 in alignment with radial blocks 38.

Tray 13 has a generally planar bottom wall 43 with an upstanding peripheral lip or rim 44. An upstanding cylindrical flange 46 forms a well 47 toward one end of the tray for holding a drink or another item.

A pair of semi-cylindrical mounting ferrules 48 are provided on the under side of the tray for engagement with mounting pins 34 on support arm 12. These ferrules are similar to ferrules 18, and they permit the tray to be rotated to different angular positions relative to the support arm, with the frictional engagement betwen the ferrules and the pins holding the tray securely in the different positions.

In one presently preferred embodiment, base 11, support arm 12 and tray 13 are each formed as a unitary structure, and they are fabricated of a suitable plastic material such as ABS by a suitable molding process.

Figure 9:
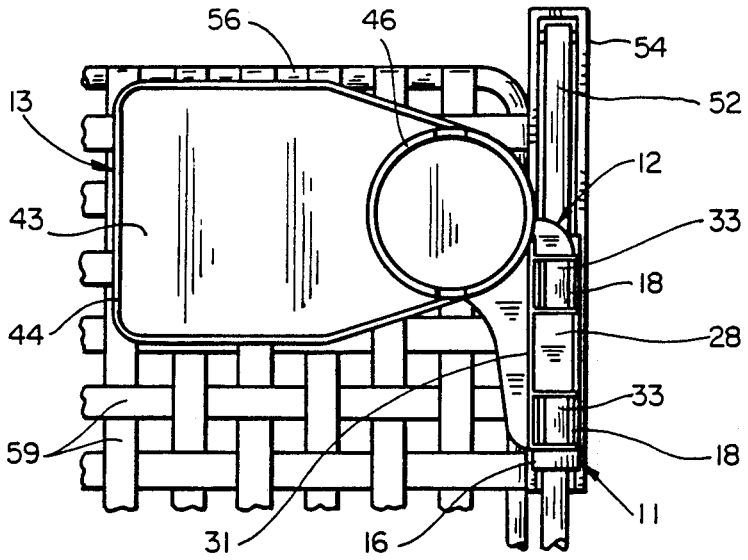

FIGS. 7–9 illustrate the use of the tray assembly in connection with a folding lawn chair 51. This chair is of conventional design and includes a pair of U-shaped tubular legs 52, 53 which are pivotally connected to armrests 54 on the two sides of the chair. U-shaped frames 56, 57 for the seat and the back of the chair are pivotally mounted on the legs, and the back frame is also pivotally connected to the rear portion of the armrests. A cross-member 58 extends between rear legs 53 at the junction of the seat and the back of the chair, and webbing 59 is mounted on the seat and back frames and trained about cross-member 58 to form a woven seat and back rest.

The tray assembly is monted on the chair by snapping the tray, support arm and base together and snapping the base onto the tubular front leg of the chair. Base 11 and support arm 12 are oriented in such manner that the axis of the mounting pins 34 for the tray extends in a horizontal direction. With most folding chairs, the legs lie in a vertical plane on each side of the chair even though the legs may be inclined from front to back. With chairs of this type, the axis of pins 34 is horizontal when the support arm extends to the side of the chair at a right angle to the plane of the legs. The orientation of tray 13 about the axis of pins 34 is adjusted to make the tray level. The tight frictional engagement between the ferrules and the mounting pins holds the tray securely in this position or in any other position to which the tray is adjusted.

In addition to permitting the tray to be adjusted to a level position, the mounting ferrules and pins also permit the tray to be left on the chair and folded over to an out of the way position when the chair is folded. As illustrated in FIG. 8, tray 13 can be rotated about mounting pins 34 to a vertical position before the chair is folded. Once the chair has been folded, base 11 can be rotated about leg 52 and support arm 18 can be pivoted in ferrules 18 to position the under side of the tray adjacent to the under side of the seat, as illustrated in FIG. 9. In this position, base 11 is oriented with ferrules 18 facing in a forward direction from chair leg 52, and support arm 12 extending in an inward direction.

The chair can be unfolded and the tray assembly returned to its operative position simply by rotating base 11 and support arm 12 so that the support arm once again extends to the side of the chair, unfolding chair, and rotating tray 13 to a level position.

Figure 10:
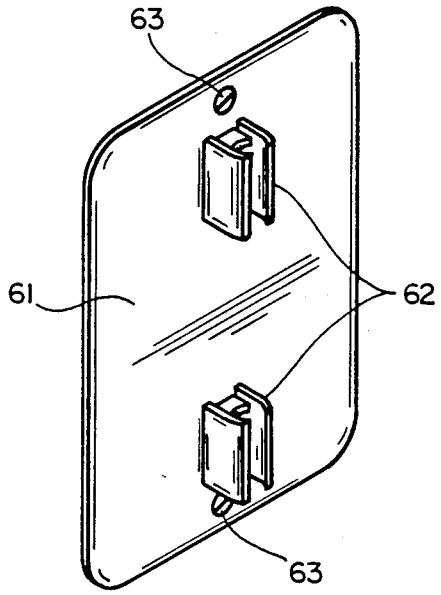
FIG. 10 is an isometric view of an alternate embodiment of a base for use in the tray assembly of FIG. 1.

FIG. 10 illustrates an alternative base which can be used in place of base 11 for mounting the tray assembly on the side of a desk or another planar supporting surface. This base comprises a generally rectangular plate 61 which has a pair of axially aligned mounting ferrules 62 and a pair of mounting screws 63 for securing the assembly to the supporting structure. Ferrules 62 are similar to ferrules 18, and they are adapted to receive mounting pins 33 in tight frictional engagement to hold the tray assembly in a stable position on the supporting structure. Any suitable means, such as an adhesive or a hook and pile fastener, can be utilized in place of mounting screws 63 for securing the base plate to the supporting surface.

In some applications, it may be possible to eliminate the base completely and mount support arm 12 directly on the supporting structure. This might be done, for example, by replacing mounting pins 33 with ferrules for direct engagement with the tubular leg of a folding chair.

It is apparent from the foregoing that a new and improved tray assembly has been provided. While only certain presently preferred embodiments have described in detail, as will be apparent to those familiar with the art, certain changes and modifications can be made without departing from the scope of the invention as defined by the following claims.

I claim:

1. In a tray assembly for use with a support: a base adapted to be mounted on the support and having a pair of semi-cylindrical mounting ferrules spaced apart along an axis which is oriented in a vertical plane when the base is mounted on the support, an L-shaped arm having a generally planar body with first and second sets of mounting pins disposed along generally perpendicular edges thereof, said first set of mounting pins snapping into the ferrules on the base and being gripped thereby with a frictional engagement which permits the arm to be rotated about the axis of the ferrules to align the second set of mounting pins in a generally horizontal plane, and a tray having a pair of spaced apart ferrules which snap onto the second set of mounting pins and grip the same so that the tray can be rotated about the horizontally aligned set of pins to a level position where it remains due to frictional engagement between the ferrules and the pins, said base, said arm and said tray each being fabricated of a plastic material with the mounting pins and ferrules being formed as integral parts thereof.

2. The tray assembly of claim 1 wherein the mounting pins have axially spaced flanges engagable with the ferrules to prevent axial movement of the ferrules relative to the pins.

3. The tray assembly of claim 1 wherein each of the ferrules has a pair of side flanges and a plurality of journal blocks spaced axially apart between the side flanges, said side flanges and said journal blocks having surfaces lying on a cylinder of slightly lesser diameter than the mounting pins for engagement with said pins.

4. The tray assembly of claim 1 wherein the base has an elongated ferrule facing in a direction generally opposite to the other ferrules on the base for snapping engagement with a cylindrical surface on the support.

5. The tray assembly of claim 1 wherein the base has a mounting plate adapted to be mounted on a generally planar surface on the support.

6. In a tray assembly: a base member fabricated of a generally rigid plastic material, a generally L-shaped arm member fabricated of a generally rigid plastic material, a first pair of connectors pivotally mounting the arm member on the base member and permitting the arm member to be moved to different angular positions relative to the base member, a tray member fabricated of a generally rigid plastic material, and a second pair of connectors pivotally mounting the tray member on the arm member and permitting the tray to be moved to different angular positions relative to the arm member, each of said connectors having a cylindrical mounting pin formed as an integral part of one of said members and a semi-cylindrical ferrule formed as an integral part of another of said members, said ferrules snapping onto said pins and gripping the same to hold the arm and tray members in a predetermined position relative to the base member.

7. The tray assembly of claim 6 wherein the mounting pins have axially spaced flanges engagable with the ferrules to prevent axial movement of the ferrules relative to the pins.

8. The tray assembly of claim 6 wherein each of the ferrules has a pair of side flanges and a plurality of journal blocks spaced axially apart between the side flanges, said side flanges and said journal blocks having surfaces lying on a cylinder of slightly lesser diameter than the mounting pins for engagement with said pins.

9. The tray assembly of claim 6 wherein the base has an elongated ferrule facing in a direction generally opposite to the first pair of connectors for snapping engagement with a cylindrical surface on a support.

10. The tray assembly of claim 6 wherein the base has a mounting plate adapted to be mounted on a generally planar surface on a support.

11. In a tray assembly for use with a generally upright cylindrical support: a base member having a semi-cylindrical mounting ferrule adapted to snap onto the cylindrical support and grip the same to hold the base in a predetermined position on the support, a generally L-shaped arm member, a first connector pivotally mounting the arm member on the base member and permitting the arm member to be moved to different angular positions relative to the base member, a tray member, and a second connector pivotally mounting the tray member on the arm member, each of said connectors having a cylindrical mounting pin formed as an integral part of one of said members and a semi-cylindrical ferrule formed as an integral part of another of said members, said ferrules snapping onto said pins and gripping the same to hold the arm and tray members in a predetermined position relative to the base member.

12. In a tray assembly for use with a generally upright cylindrical support: a base having a first semi-cylindrical mounting ferrule adapted to snap onto the cylindrical support and grip the same to hold the base in a predetermined position on the support and a pair of semi-cylindrical ferrules which face in a direction generally opposite the first ferrule and being spaced apart along an axis which is oriented in a vertical plane when the base is mounted on the support, an L-shaped arm having a generally planar body with first and second sets of mounting pins disposed along generally perpendicular edges thereof, said first set of mounting pins snapping into the ferrules on the base and being gripped thereby with a frictional engagement which permits the arm to be rotated about the axis of the ferrules to align the second set of mounting pins in a generally horizontal plane, and a tray having a pair of spaced apart ferrules which snap onto the second set of mounting pins and grip the same so that the tray can be rotated about the horizontally aligned set of pins to a level position where it remains due to frictional engagement between the ferrules and the pins, said base, said arm and said tray each being fabricated of a rigid plastic material with the mounting pins and ferrules being formed as integral parts thereof.

13. In a tray assembly: a generally planar tray member fabricated of a generally rigid plastic material, an arm member fabricated of a generally rigid plastic material for supporting the tray member, a cylindrical mounting pin formed as an integral part of one of said members, and a semi-cylindrical ferrule formed as an integral part of the other of said members, said ferrule having a pair of side flanges and a plurality of journal blocks spaced axially apart between the side flanges, said side flanges and said journal blocks haivng surfaces lying on a cylinder of slightly lesser diameter than the mounting pin, whereby the ferrule is adapted to snap onto the pin and grip the pin with a frictional engagement which permits the tray member to be moved to different angular positions relative to the arm member and to remain in those positions until moved therefrom.

14. The tray assembly of claim 13 wherein the mounting pin has axially spaced flanges engagable with the ferrule to prevent axial movement of the ferrule relative to the pin.

15. The tray assembly of claim 13 including a base member fabricated of a generally rigid plastic material adapted to be mounted on a support, a second mounting pin formed as an integral part of one of said arm and base members, and a second ferrule formed as an integral part of the other of said arm and base members, said second ferrule snapping over said second pin and gripping the same with a tight frictional engagement which permits the arm member to be moved to different positions relative to the base member and to remain in said positions until moved therefrom.

16. The tray assembly of claim 15 wherein the base member has an elongated ferrule facing in a direction generally opposite to the pin and ferrule on the base and arm members for snapping engagement with a cylindrical surface on the support.

17. The tray assembly of claim 15 wherein the base member has a mounting plate adapted to be mounted on a generally planar surface on the support.

18. The tray assembly of claim 13 wherein the tray member includes an upstanding peripheral rim, and an upstanding cylindrical flange defining a well for holding an object such as a glass.

* * * * *